United States Patent [19]

Brand

[11] 4,143,761

[45] Mar. 13, 1979

[54] SAFETY MATCH BOOK

[76] Inventor: Francis P. Brand, 163 Lincoln Blvd., Long Beach, N.Y. 11561

[21] Appl. No.: 591,033

[22] Filed: Jun. 27, 1975

[51] Int. Cl.[2] ..... A24F 27/20; A24F 27/26

[52] U.S. Cl. ..... 206/106; 44/44; 44/45; 44/48; 206/108; 206/109; 206/459

[58] Field of Search ..... 44/44, 45, 48; 206/106, 206/108, 109, 459

[56] References Cited

U.S. PATENT DOCUMENTS

| | | | |
|---|---|---|---|
| 483,165 | 9/1892 | Pusey | 44/44 |
| 1,982,176 | 11/1934 | Pullen | 44/45 X |
| 2,691,881 | 10/1954 | Knutsson-Hall | 44/45 X |
| 3,967,725 | 7/1976 | Thompson | 206/108 |
| 4,053,048 | 10/1977 | Cohn | 206/106 |

FOREIGN PATENT DOCUMENTS

| | | | |
|---|---|---|---|
| 346253 | 4/1931 | United Kingdom | 44/45 |

*Primary Examiner*—Carl Dees

*Attorney, Agent, or Firm*—Ostrolenk, Faber, Gerb & Soffen

[57] ABSTRACT

A safety match book having a flexible cover enclosing a plurality of matchsticks each having an end tearably fastened to at least one binding strip; a match striking surface formed on an interior surface of the match book cover normally abutting one binding strip; and means for fastening the match book cover to all the strips in a region between the striking surface and another end of the matches. A portion of the match book cover, enclosing all the binding strips and the striking surface, extends a sufficient distance beyond the end of the binding strips opposite the other matchstick ends whereby the match striking surface normally abutting the binding strip may be moved outwardly a sufficient distance to allow the head of a matchstick torn from the binding strip to be inserted between the match striking surface and the binding strip exterior surface when pressure is applied to the match book cover in the direction forcing the striking surface toward the binding strip. The matchstick head is ignitable only when pressure is placed on a back portion of the match book cover directly over the match head to force both the striking surface and the binding strip against the inserted match head, whereby the match head may be withdrawn from the match book cover to frictionally raise the match head temperature to its ignition point.

9 Claims, 2 Drawing Figures

SAFETY MATCH BOOK

BACKGROUND OF THE INVENTION

The present invention relates to safety match books and more particularly to a novel safety match book having a match striking surface positioned within a pouch section to enable insertion and subsequent ingnition of a match head only when a specific sequence of forces is applied to the pouch section.

It is well known in the art to form a match book of a flexible sheet of material, such as cardboard and the like, enclosing at least one row of match sticks tearably fastened to a binding strip at an end opposite the match head and having a match striking surface positioned on the exterior of the match book cover adjacent to the binding strip. Safety reasons have dictated that the match striking surface be positioned upon the exterior surface of the match book rear cover portion, thereby preventing accidental ignition of the remainder of the match heads when a torn-off match stick is rubbed upon the striking surface until it is ignited. There has been considerable consumer interest in a child-proof match enclosure, whereby an infant will be unable to cause the ignition of a match torn from the strip of matches enclosed within the match book. This continuing safety interest has resulted in various attempts to provide the child-proof match enclosure: U.S. Pat. No. 1,724,712, issued Aug. 13, 1929 to E. B. Hough, discloses strips of tearable match sticks within a match box having a pair of complementary separable cover members pivotable at one end thereof, whereby one half of the match box must be pivoted away from the other half to reveal a strip of matchsticks, allow one matchstick to be torn from the strip, and be ignited against an enclosed striking surface; U.S. Pat. No. 2,935,185, issued May 3, 1960, to T. Will, disclosing a striking surface normally positioned between several folds of a snap-up portion of the match book cover. Both the Hough and Will match enclosures allow a child to easily open the enclosure, tear a match from the exposable strip of matches and rub the head of the torn match against the easily striking surface.

It is desirable to provide a safety match book having a striking surface generally both inaccessible and unusable by an infant.

BRIEF SUMMARY OF THE INVENTION

In accordance with the invention, a safety match book enclosing a plurality of matchsticks, each having a frictionally ignitable match head on one end thereof, the other end of each matchstick being tearably fastened to a binding strip; a cover member of cardboard or the like completely enclosing at least one strip of matchsticks, the cover member having a continuous back portion and separable first and second front portions, one of the front portions forming a liftable flap frictionally held against the frontmost strip of matchsticks by the other front portion which is a continuation of the back cover portion; a match striking surface positioned on an interior surface of the match cover rear portion adjacent the binding strip; and fastening means passing through the back portion and the other front portion of the match book cover for securely fastening each binding strip therebetween with said striking surface normally abutting a rearward exterior binding surface. A fold formed between the back portion and the other front portion extends a predetermined distance from the end surface of the binding strip opposite the matchstick heads, whereby the extra bottom web is pressed towards the binding strip to separate the match striking surface from the rearward exterior surface of the binding strip a sufficient distance to insert the head of a single match therebetween, the match striking surface being adapted to frictionally engage the head of the matchstick to cause ignition of the match head only when a predetermined minimum force is applied to an exterior rear portion of the match book opposite the striking surface to press the striking surface against the match head and the match head against the binding strip while the matchstick is coordinately pulled from between binding strip and match striking surface.

The safety match book just described has the advantage that a match head cannot be positioned against a match striking surface and ignited by an infant not possessing sufficient coordination to press a specific match book portion to allow insertion of the match head adjacent the striking surface and then to press another match book portion while withdrawing the now-enclosed match head in a specific direction to cause the required ignition friction therebetween.

Accordingly, it is the primary object of the present invention to provide a novel safety match book cover for preventing accidental ignition of a match head.

It is another object of the present invention to provide a novel safety match book having a match striking surface remotely positioned from an operable portion of the match book cover.

It is a further object of the present invention to provide a novel safety match book requiring pressure upon successively different portions of a match book cover for ignition of a match, which match cover manipulation cannot be performed by an infant.

These and other objects of the invention will become apparent from the following detailed description of the accompanying drawings.

DETAILED DESCRIPTION OF THE INVENTION

Figure 1:
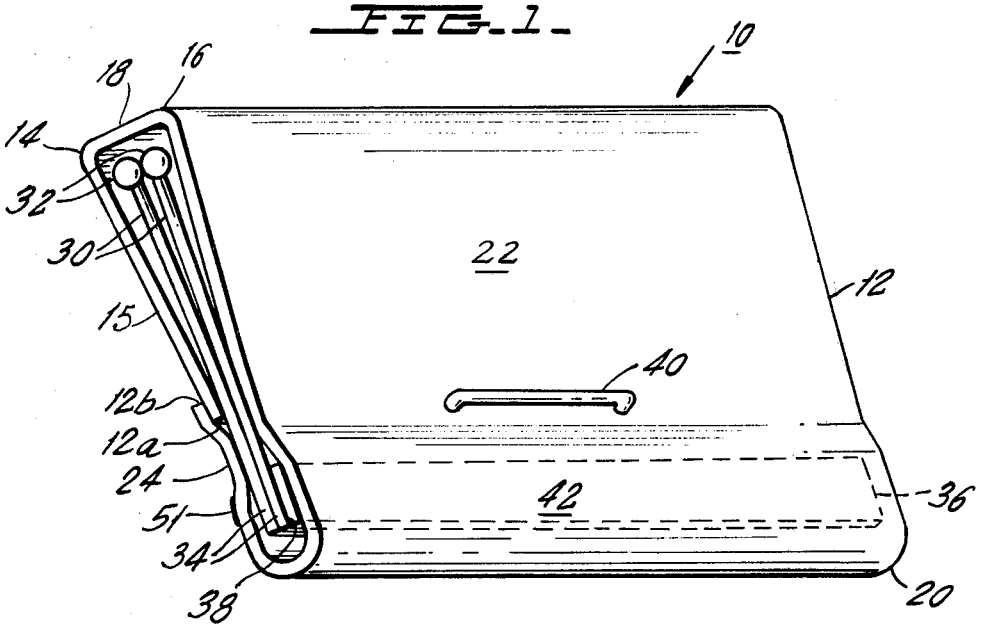
FIG. 1 is a perspective view of a normally closed safety match book in accordance with the present invention.
Figure 2:
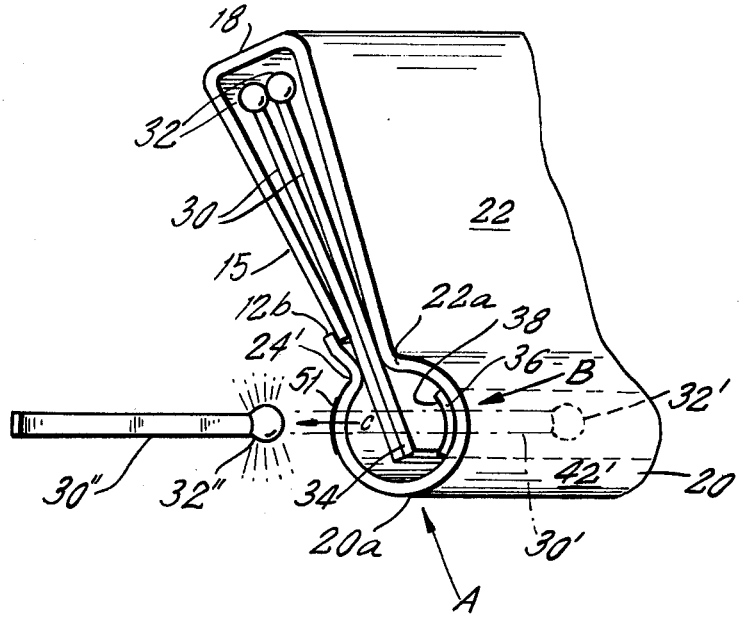
FIG. 2 is a partial perspective view of a safety match book in accordance with the invention illustrating the opening of the striking section and the succession of steps required for igniting a match head.

Referring now to the drawings, a safety match book 10 has a cover formed of a continuous sheet 12 of semi-flexible cover material, such as cardboard or the like. Sheet 12 is sharply folded at a first fold line 14 a predetermined first distance from a first cover sheet end **12*a* to form an opening flap 15 for match book 10. A second sharp crease line 15 is formed a second predetermined distance from first fold line 14 opposite match book cover first end 12*a* to form a flat match book cover top portion 18 between first and second predetermined fold lines 14 and 16 respectively. A gradually folded portion 20 is formed a third predetermined distance from second fold line 16 towards match book cover other end 12*b*, to form a match book back cover portion 22 between second fold line 16 and portion 20. The remaining portion of match book cover 12 between portion 20 and cover second end 12*b* forms a lower front match book cover portion 24 generally parallel to back portion 22. A plurality of matchsticks 30, each having a match head 32 formed of friction-ignitible chemicals, are serially arranged along at least one match binding strip 34 to which the end of each matchstick 30 opposite match head 32 is fastened by means adapted to allow tearable separation of a single matchstick 30 from its associated binding strip 34. Gradually folded portion 20 and adjacent sections of back and lower front portions 22 and 24, respectively, form a pouch-like section below binding strips 34**.

A match striking member 36 has a first exterior surface fastened to a portion of the interior surface of back cover portion 22 at a position adapted to place an abrasive second exterior surface 38 adjacent binding strip 34. Strip 36 is fastened to cover 12 by suitable means, such as glue, adhesive and the like. Fastening means, such as one or more staples 40, pass through a portion of the back cover 22 between striking surface bearing portion 42 and second fold 16, through enclosed aligned binding strips 34 and a corresponding portion of lower front cover portion 24 adjacent cover second end **12*b*. In a preferred embodiment, the material from which cover 12 is formed has sufficient stiffness to normally cause abrasive striking surface 38 to abut the adjacent exterior surface of binding strip 34**.

The thickness of the material forming cover 12 is selected to require at least a predetermined minimum magnitude of force applied in the direction of arrow A normal to the lowermost exterior surface **20*a* of gradually folded portion 20 to cause the pouch-like section to open and to allow the match head 32' of a single matchstick 30', previously separated from binding strip 34, to be inserted into the opened pouch-like section to be positioned between the spaced exterior surface of binding strip 34 and abrasive striking surface 38. While the resiliency of the cover material causes the separated lower front cover portions 42', 24' to partially return towards the normal condition whereby these portions are generally parallel and abutting binding strip 34 when the pouch section opening force is removed, the stiffness of matchsticks 30 and the stiffness of the preselected cover material usually are insufficient to permit match head 32' from being drawn along abrasive striking surface 38 with enough force to sufficiently ignite match head 32'**.

Ignition of match head 32' normally requires the application of sufficient pressure in the direction of arrow B normal to the exterior surface of back cover portion 22 opposite striking surface bearing portion 42 to force both abrasive striking surface 38 and the adjacent exterior surface of binding strip 34 against diametrically opposed portions of binding strip 34 against diametrically opposed portions of match head 32' positioned therebetween. Simultaneously with the application of pressure to cover end **22*a* in direction of arrow B, tension must be applied to the exposed portion of matchstick 30' opposite match head 32' in the direction of arrow C to pull match head 32' from the pouch section, causing sufficient frictional heat energy to be transferred to match head 32'** until its ignition temperature is reached.

Match head 32'' of match 30'' will be ignited when pulled from the pouch-like section only if simultaneously forces are applied in the direction of arrows B and C. Thus, even if opening flap 15 is released from lower front cover portion 24 and a matchstick 30 is separated from binding strip 34, coordinated movements are required to apply opening pressure in the direction of arrow A to the pouch-like section to initially project match head 32 therein. Even if the pouch-like section is opened to allow match head 32' to be placed between abrasive surface 38 and binding strip 34, the resiliency of the cover material is insufficient to allow ignition unless the additional simultaneously coordinated forces in the directions of arrows B and C are also applied while matchstick 30' is being withdrawn from the pouch-like section; a combination of coordinated force applications to specific portions of the matchbook cover which are not generally capable of being carried out by an infant or young child.

There has just been described a novel safety matchbook having a match striking surface positioned within a pouch-like section of the matchbook cover to enable insertion and subsequent ignition of a match head only when a specific sequence of forces are applied to the matchbook pouch-like section, thereby preventing an infant or young child not possessed of the required coordination from igniting a match. However, it should be apparent that the application of force in the direction of arrow B becomes unnecessary if the cover material is sufficiently resilient or if the matchsticks are of sufficient strength.

In order to even further reduce the likelihood of an infant or young child igniting a match, the exterior of the matchbook cover is provided with simulated match striking strip 51. Strip 51 is in the same location and has the same appearance as a conventional striking strip (not shown). However, simulated striking strip 51 is "non-abrasive". That is, the abrasive qualities of strip 51 are insufficient to cause ignition of a match head 32 that is vigorously rubbed against strip 51. Thus, strip 51 acts as a decoy which diverts attention from concealed striking strip 36.

The present invention has been described in connection with one preferred embodiment thereof; many variations and modifications will now become apparent to those skilled in the art. It is preferred, therefore, that the present invention be limited not by the specific disclosure herein but only by the appended claims.

The embodiments of the invention in which an exclusive privilege or property is claimed are defined as follows:

1. A safety match unit including a plurality of match sticks each having a frictionally ignitable head, elongated binding strip means to which the other ends of said match sticks are separably secured, sheet means including a portion forming an elongated pouch into which said binding strip means is entered, the axis of said pouch extending substantially normal to said match sticks, another portion of said sheet means including an openable enclosure wherein said match sticks are disposed, means defining a match striking surface disposed within said pouch, said pouch normally being closed to prevent entry therein of an ignitable head through a side opening of said pouch into operative engagement with said striking surface, and a simulated match striking surface positioned on the exterior of the enclosure and having abrasive qualities that are insufficient to cause ignition of said ignitable match heads when the latter are rubbed against said simulated match striking surface.

2. A safety match unit as set forth in claim 1 in which the sheet means has sufficient resiliency to self-bias said pouch closed.

3. A safety match unit as set forth in claim 1 in which each of said sticks has insufficient bending strength whereby a force applied to said stick at a point remote from its said head and transverse to the axis of said stick fails to produce sufficient friction force between said striking surface and said head to ignite the latter.

4. A safety match unit as set forth in claim 3 in which the sheet means has sufficient resiliency to self-bias said pouch closed.

5. A safety match unit as set forth in claim 1 in which the striking surface is secured to said sheet means and confronts a first surface of said strip, said striking surface being operatively positioned so that an ignitable head inserted into said pouch is positioned between said striking surface and said first surface.

6. A safety match unit as set forth in claim 5 in which merely drawing said ignitable head across said striking surface will not ignite said head, said pouch being constructed so that the application thereto of an external force will clamp said head between said striking surface and said first surface whereby withdrawing of said head from said pouch rubs said head against said striking surface developing a friction force sufficient to ignite said head.

7. A safety match unit as set forth in claim 6 in which the pouch is positioned at one end of the enclosure, said enclosure including a back and an openable cover hinged to said back at the other end of the enclosure.

8. A safety match unit as set forth in claim 7 in which the sheet means also forms a holding portion extending from said pouch partway toward said other end of said enclosure and operatively positioned to releasably hold said cover closed.

9. A safety match unit as set forth in claim 8 in which the sheet means has sufficient resiliency to self-bias said pouch closed.

* * * * *